US010259679B2

(12) United States Patent
Kirill

(10) Patent No.: US 10,259,679 B2
(45) Date of Patent: Apr. 16, 2019

(54) DEVICE FOR SEPARATING, SAVING AND STORING AN ADHESIVE TAPE LEADING EDGE

(71) Applicant: 6F Designs, LLC, Henrico, VA (US)

(72) Inventor: Linnette Kirill, Henrico, VA (US)

(73) Assignee: Tape-Tab, L.P., Richmond, VA (US)

( * ) Notice: Subject to any disclaimer, the term of this patent is extended or adjusted under 35 U.S.C. 154(b) by 359 days.

(21) Appl. No.: 14/929,477

(22) Filed: Nov. 2, 2015

(65) Prior Publication Data

US 2016/0130111 A1 May 12, 2016

Related U.S. Application Data

(60) Provisional application No. 62/077,914, filed on Nov. 11, 2014.

(51) Int. Cl.
*B65H 75/28* (2006.01)

(52) U.S. Cl.
CPC ..... *B65H 75/285* (2013.01); *B65H 2701/377* (2013.01)

(58) Field of Classification Search
CPC ..... Y10T 225/20; Y10T 225/217; Y10T 225/257; Y10T 225/259; B65H 72/285; B65H 2701/377
See application file for complete search history.

(56) References Cited

U.S. PATENT DOCUMENTS 2,262,260 A * 11/1941 Smith ..... B65H 35/008 225/56
2,760,573 A * 8/1956 Guyot ..... B65H 35/008 225/10
3,134,526 A * 5/1964 Schleicher ..... B65H 35/0026 225/33
3,138,310 A * 6/1964 Blodee ..... B65H 35/008 225/65
5,788,807 A * 8/1998 Gratz ..... B65H 35/0026 156/577
2003/0205602 A1* 11/2003 Huang ..... B65H 35/002 225/43
2004/0060955 A1* 4/2004 Cheng ..... B65H 35/0026 225/6
2008/0016638 A1* 1/2008 Morris ..... A47L 13/20 15/228
2014/0124145 A1* 5/2014 Parkhe ..... B65H 35/0026 156/527

OTHER PUBLICATIONS

"No Sticky Ends With the Tape Saver—Promo Product," Post on Aug. 2, 2013 by Joel [retrieved on Oct. 28, 2015], ODM Group, Retrieved from the Internet: http://www.theodmgroup.com/2013/08/02/tape-saver-promo-product, 1 p.

* cited by examiner

*Primary Examiner* — Phong H Nguyen
(74) *Attorney, Agent, or Firm* — Dawn-Marie Bey; Bey & Cotropia PLLC

(57) ABSTRACT

A device for accessing and storing tape on a tape roll is a single unitary construction and includes a textured grip portion; a tape rest portion; a blade edge; and a base opposite the textured grip portion, the tape rest portion, and the blade edge wherein a width of the device is approximately equal to a width of a roll of tape.

8 Claims, 13 Drawing Sheets

DEVICE FOR SEPARATING, SAVING AND STORING AN ADHESIVE TAPE LEADING EDGE

CROSS-REFERENCE TO RELATED APPLICATION

The present application claims priority to and the benefit of U.S. Provisional patent application No. 62/077,914 entitled "Tape-Tab Starts and Stores an Adhesive Tape Leading Edge," filed Nov. 11, 2014.

BACKGROUND OF THE EMBODIMENTS

Field of the Embodiments

The devices described and illustrated herein are generally directed to tape storage and/or saver devices. More particularly, the devices are directed to a tape-tab and a tape-wedge for storing the leading edge of an adhesive tape roll when the tape is not in use.

Description of Existing Art

Adhesive tape rolls are generally marketed and sold either as standalone rolls or in combination with a dispenser that provides a cutting mechanism. Tape rolls come in many different sizes; generally measured in terms of width. The following table provides standard widths for common types of tape:

TABLE 1

| U.S. Standard Widths | Converted Metric Widths |
|---|---|
| ½ inch (clear) | 15 mm |
| ¾ inch (scotch tape, clear adhesive) | 19 mm |
| 0.78 inch wide (washi tape) | 19 mm |
| 1.88 inch (Duct tape) | 48 mm |
| 1 inch (masking tape) | 25-26 mm |
| 2 inch (masking tape/paint tape) | 51 mm |

Regardless of width or material, all adhesive tape rolls are susceptible to re-adhesion of the end of the tape to the roll when not in use, or worse, while in use. As anyone who has tried can attest to, it can be time-consuming to try to locate and separate the end or edge of the tape from the roll. Further, there is invariably some loss of tape upon separation due to splitting or mangling of the ends. While various dispensers are available for holding the end of the tape away from the roll, not all tape rolls come with dispensers. And not all types of tape are conducive to standard dispensers. Furthermore, most dispensers include a jagged edge for holding and/or cutting the tape from the roll. This jagged edge could cause injury to users; particularly children. Further still, if the end of the tape comes loose from the jagged edge and re-adheres to the roll, the issues discussed above regarding separating the edge once again become a problem.

Accordingly, there is a need in the art for a safe and effective device for facilitating and maintaining a separation between a tape end and the tape roll.

SUMMARY OF THE EMBODIMENTS

In a first exemplary device for accessing and storing tape on a tape roll, the device comprises the following portions in a single unitary construction: a textured grip portion; a tape rest portion; a blade edge; and a curved base opposite the textured grip portion, the tape rest portion, and the blade edge wherein a width of the device is approximately equal to a width of a roll of tape.

In a second exemplary device for accessing and storing tape on a tape roll, the device comprises the following portions in a single unitary construction: a textured grip portion; a tape rest portion; a blade edge; and a straight base edge opposite the textured grip portion and the tape rest portion, wherein the straight base edge includes three sides, a first side connecting to a width edge of the textured grip portion, a second side connecting to a first lengthwise edge of the device running along the textured grip portion and the tape rest portion and a third side opposite the second side and connecting to a second lengthwise edge of the device running along the textured grip portion and the tape rest portion; further wherein a width of the device is approximately equal to a width of a roll of tape.

In a third exemplary device for accessing and storing tape on a tape roll, the device comprises the following portions in a single unitary construction: a top curved surface including a textured grip portion covering; a tape rest portion; a blade edge; and a bottom curved surface opposite the top curved surface, wherein the top curved surface and the bottom curved surface are approximately parallel and further wherein the top curved surface and the bottom curved surface are separated by less than 2 mm at a first end of the device and less than 1 mm at a second end of the device.

BRIEF DESCRIPTION OF FIGURES

The Summary of the Embodiments, as well as the following Detailed Description, is best understood when read in conjunction with the following exemplary drawings.

DETAILED DESCRIPTION

Figure 1A:
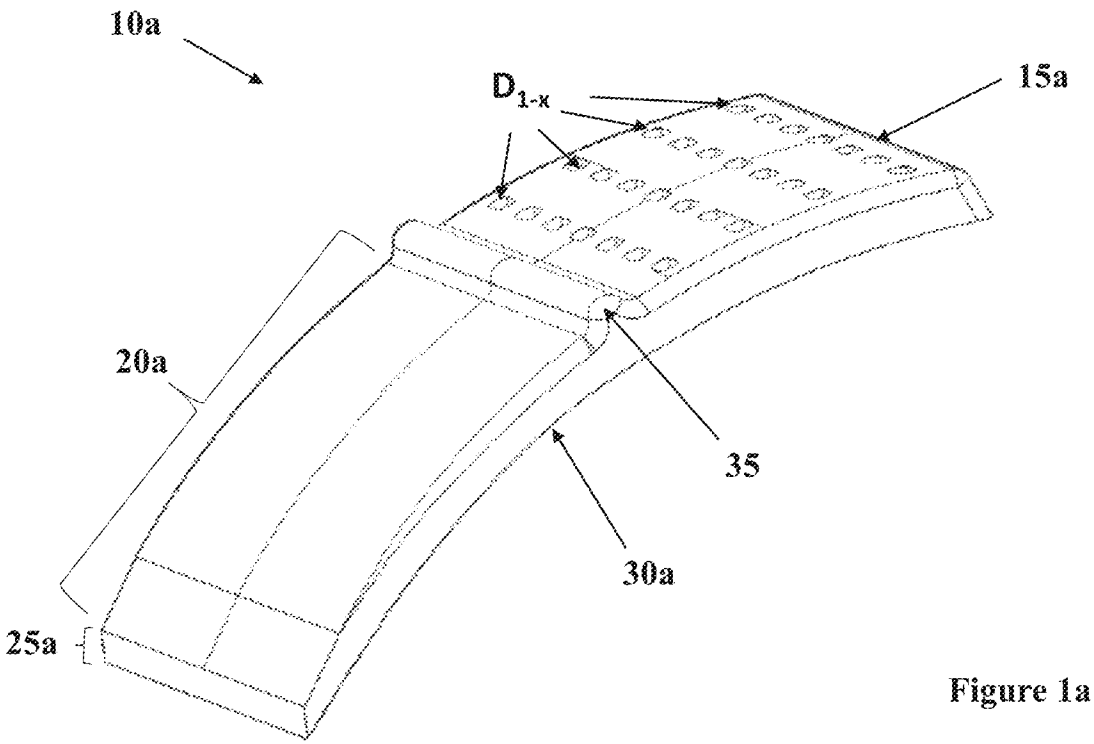
FIGS. 1*a*-1*c* illustrate an exemplary tape-tab in accordance with a first embodiment.
Figure 1B:
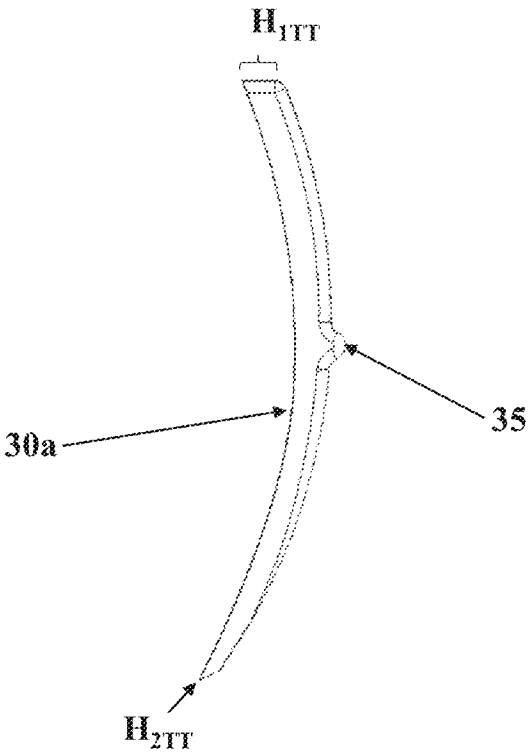
Figure 1C:
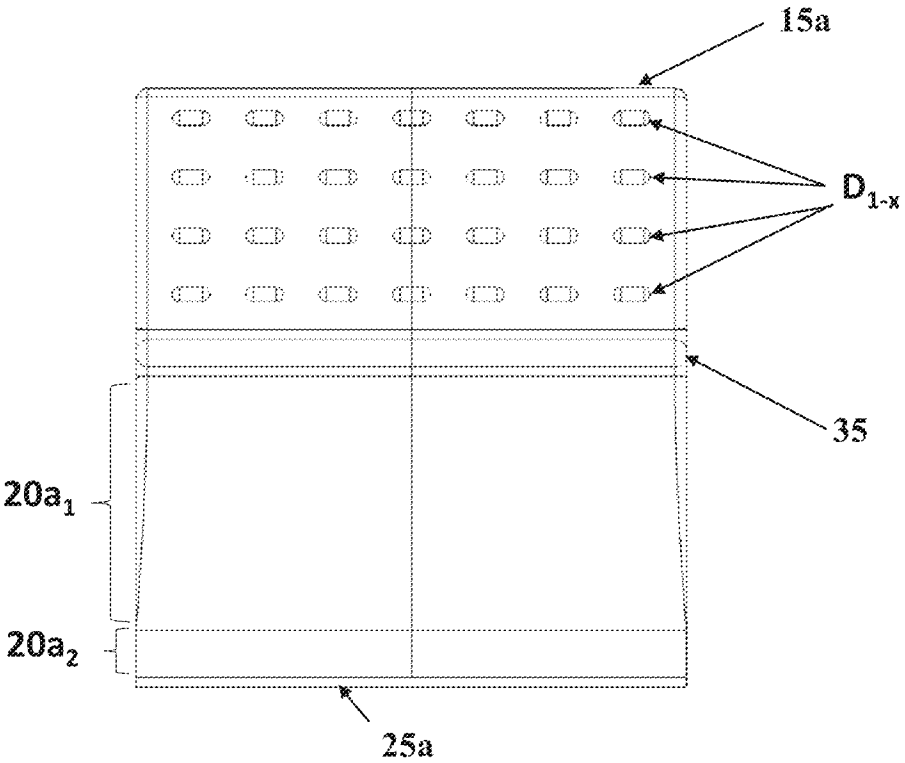

Referring to FIGS. 1*a*-1*c*, a first embodiment of the tape-tab 10*a* is shown. The tape-tab 10*a* is a one-piece construction which is preferably formed of a plastic material. The primary components of the tape-tab 10*a* include a textured grip portion 15*a*, a tape rest portion 20*a*, a blade edge 25*a*, and curved base 30*a* molded into a single product. Additionally, tape-tab 10*a* is formed with a ridge 35 at the intersection of grip portion 15*a* and tape rest portion 20*a*

Figure 9:
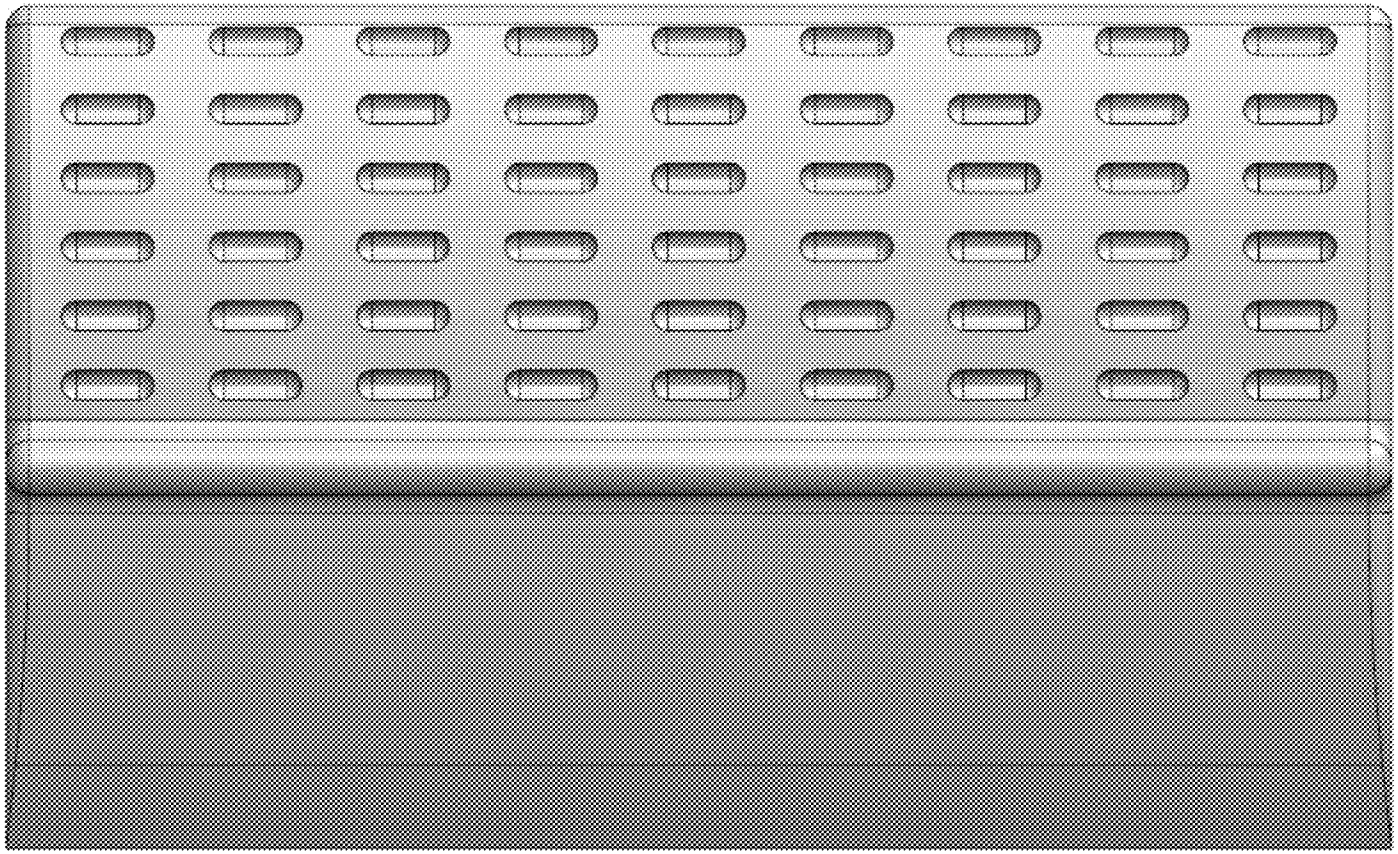
FIG. 9 illustrates an alternative tape-tab embodiment to FIGS. 1*a*-1*c* having additional divots.
Figure 10:
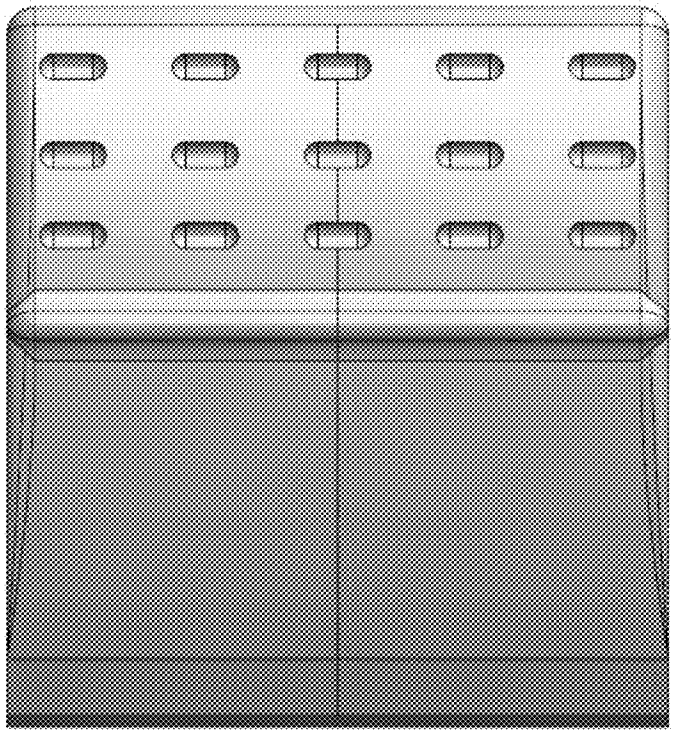
FIG. 10 illustrates an alternative tape-tab embodiment to FIGS. 1*a*-1*c* having fewer divots.

(see FIG. 1*b*). This ridge 35 provides an additional gripper for the user and helps maintain the structural integrity of the tape-tab 10*a* to minimize breakage at the point of intersection. Further, the tape rest portion 20*a* may include two curved sloped portions or a curved slope $\mathbf{20}a_1$ and intermediate bevel $\mathbf{20}a_2$ as better illustrated in the top view of FIG. 1*c*. Alternately, the tape rest portion 20*a* may include a single continuous curved slope 20*b* as shown in the alternative embodiment of FIG. 2 discussed below. The textured grip portion 15*a*, curved slope portions of tape rest portion 20*a*, and curved base 30*a* are shaped in parallel curves which are themselves generally parallel to the radius of curvature of a particular tape roll. The textured grip portion 15*a* may include a pattern of indentations or divots $D_{1-x}$ formed therein to improve gripping. The number and pattern of divots may be optimized to maximize user grip, while maintaining structural integrity (see FIG. 9 and FIG. 10 illustrating alternative embodiments).

Figure 2:
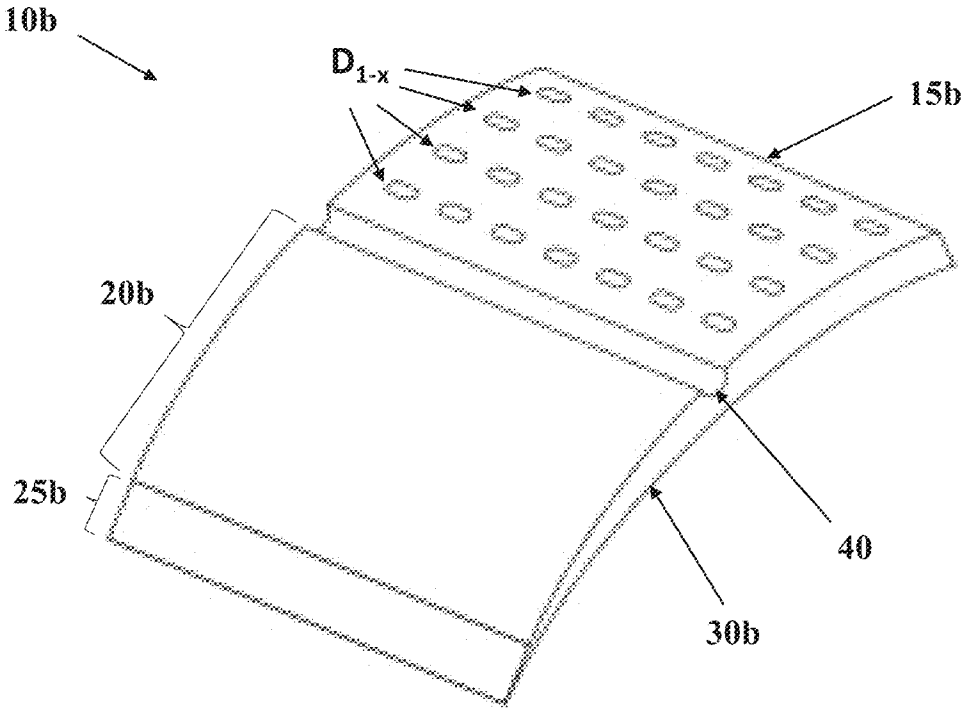
FIG. 2 illustrates an exemplary tape-tab in accordance with a second embodiment.

Referring to FIG. 2, a second embodiment of the tape-tab 10*b* is shown. The tape-tab 10*b* is a one-piece construction which is preferably formed of a plastic material. The primary components of the tape-tab 10*b* include a textured grip portion 15*b*, a tape rest portion 20*b*, a blade edge 25*b*, and curved base 30*b* molded into a single product. Additionally, tape-tab 10*b* is formed with a trough 40 at the intersection of grip portion 15*b* and tape rest portion 20*b*.

The dimensions $L_{TT}$, $W_{TT}$, $H_{1TT}$, $H_{2TT}$ of the tape-tabs 10*a* and 10*b* may vary in accordance with the dimensions of the tape roll with which they are intended to be used. In particular, the width of the tape roll dictates W (see Table 1). By way of example, tape-tabs 10*a* and 10*b* illustrated herein generally have the approximate dimensions: $L_{TT}$=22 mm; $W_{TT}$=19.5 mm; $H_{1TT}$=1.6 mm and $H_{2TT}$=tapered to point. Additionally, blade edge 25*a* of tape-tab 10*a* is approximately 0.8 mm and blade edge 25*b* of tape-tab 10*b* is approximately 0.1 mm as it approaches a point. While the value for width ($W_{TT}$) is generally driven by the width of the tape roll, the value for $H_{1TT}$ (also referred to as thickness) is generally less than 2.0 mm. The values provided herein are in no way intended to be limiting.

Figure 3:
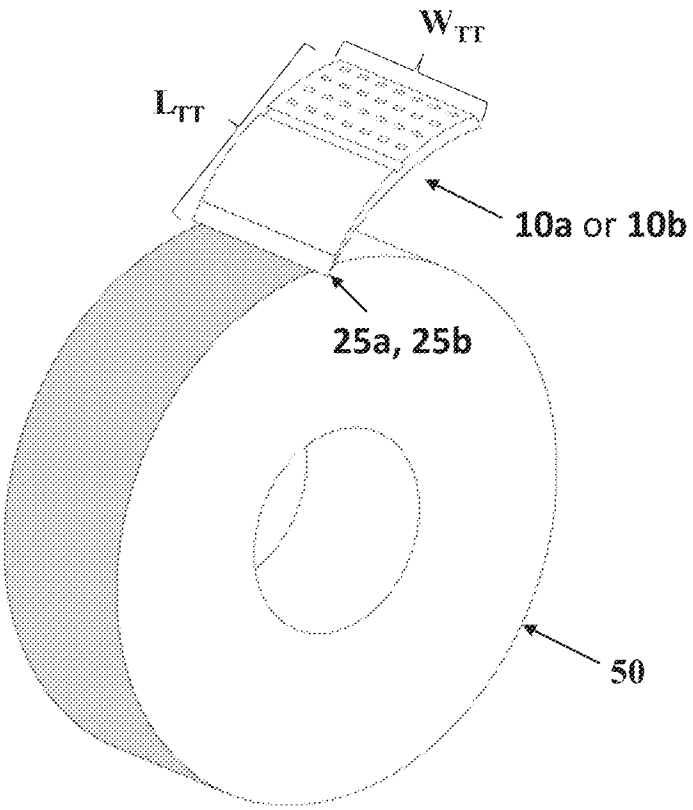
FIG. 3 illustrates a first position of an exemplary tape-tab with blade edge to separate a leading edge of adhesive tape.
Figure 4:
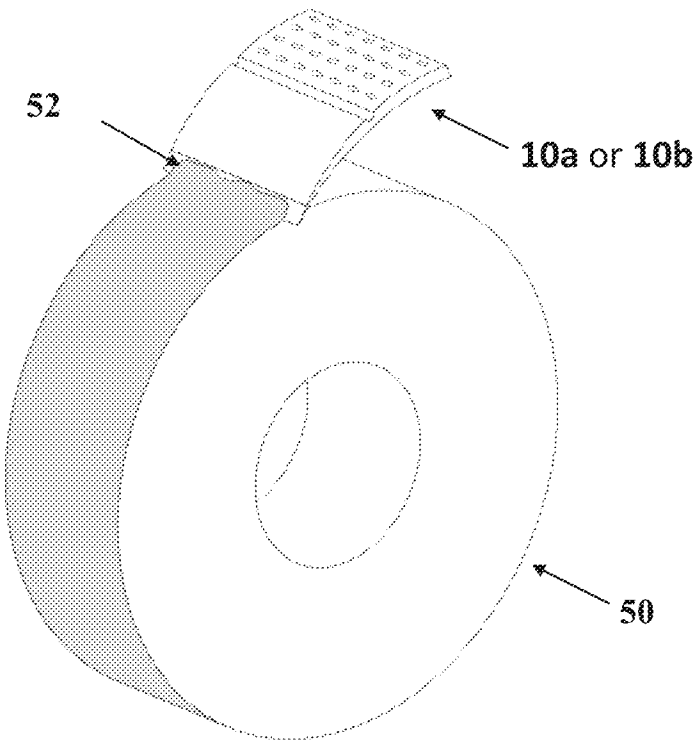
FIG. 4 illustrates the exemplary tape-tab blade edge pushing under the leading tape edge and separating the tape from the adhesive roll.
Figure 5:
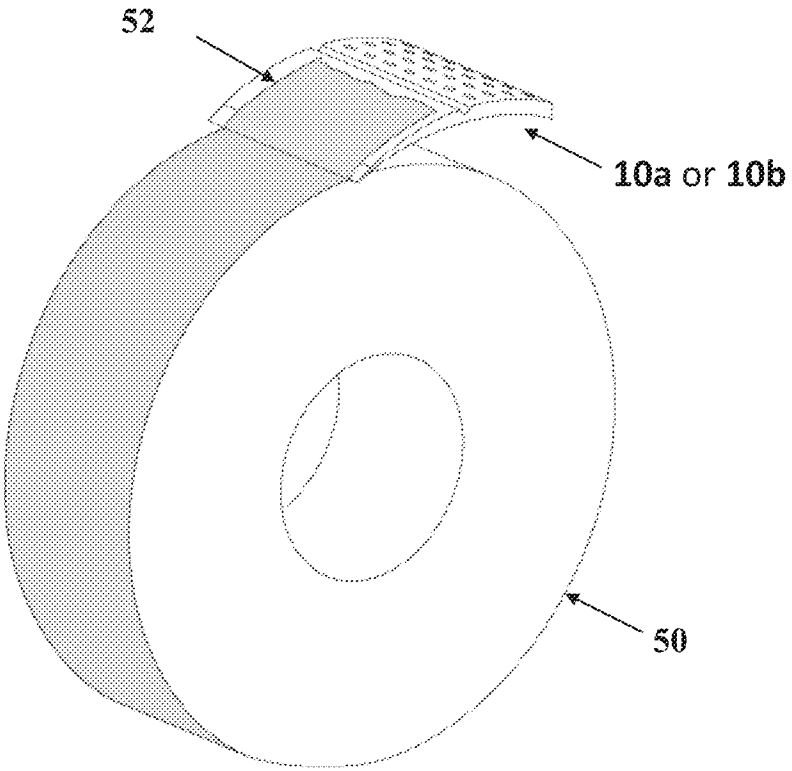
FIG. 5 illustrates the exemplary tape-tab with the leading edge of the tape adhered to the tape rest section of the exemplary tape-tab.
Figure 6:
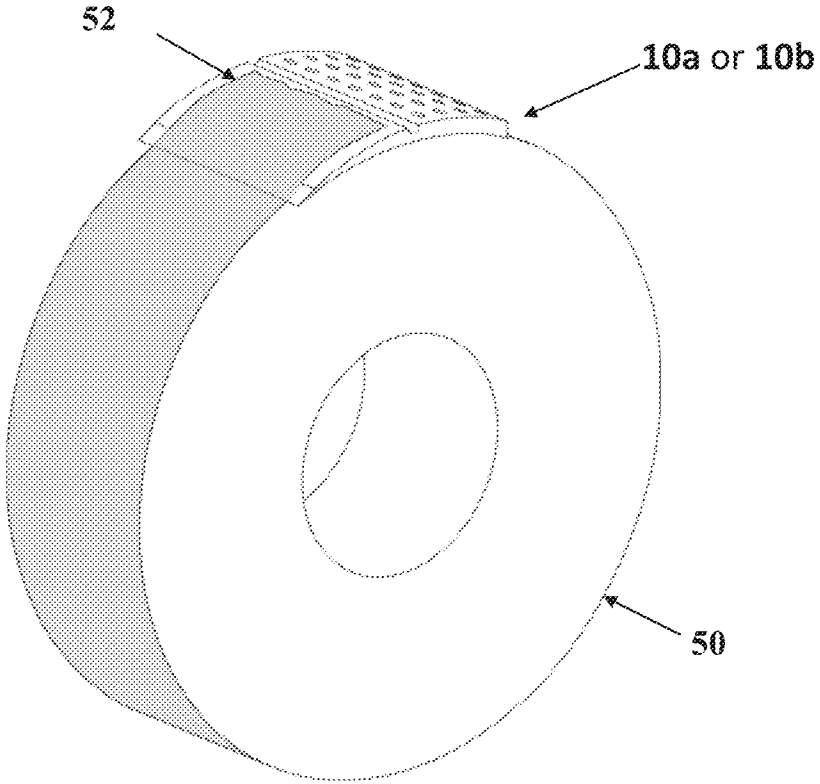
FIG. 6 illustrates the exemplary tape-tab in the final storage position with the leading edge of the tape adhered to the exemplary tape-tab rest area and curved tape-tab resting on tape roll.

FIGS. 3-6 illustrate exemplary steps of using the tape-tabs 10*a* and 10*b*. In use, the user grips the tape-tab 10*a* or 10*b* at the textured grip portion 15*a*, 15*b*. As shown in FIGS. 3-4, the user presses the blade edge 25*a*, 25*b* at the leading tape edge 52 of the adhesive tape roll 50 and pushes the blade edge 25*a*, 25*b* under the leading tape edge 52 using a scraping motion until the leading tape edge 52 has separated from the adhesive tape roll 50 and the user can unroll the tape as desired. Referring to FIGS. 5-6, when the user is ready to store the tape, the user grips the tape-tab 10*a* or 10*b* at the textured grip portion 15*a*, 15*b* of the tape-tab placing it under the loosened tape edge 52 up to the tape rest portion 20*a*, 20*b* and presses the tape edge 52 adhering it to the tape rest portion 20*a*, 20*b*. The tape edge 52 is secure and is prevented from re-adhering to the tape roll 50. The tape edge 52 is in the ready position for the next use. As illustrated in FIG. 6, the curved base 30*a*, 30*b* has a curve that generally corresponds to the curvature of the tape roll 50.

Figure 7B:
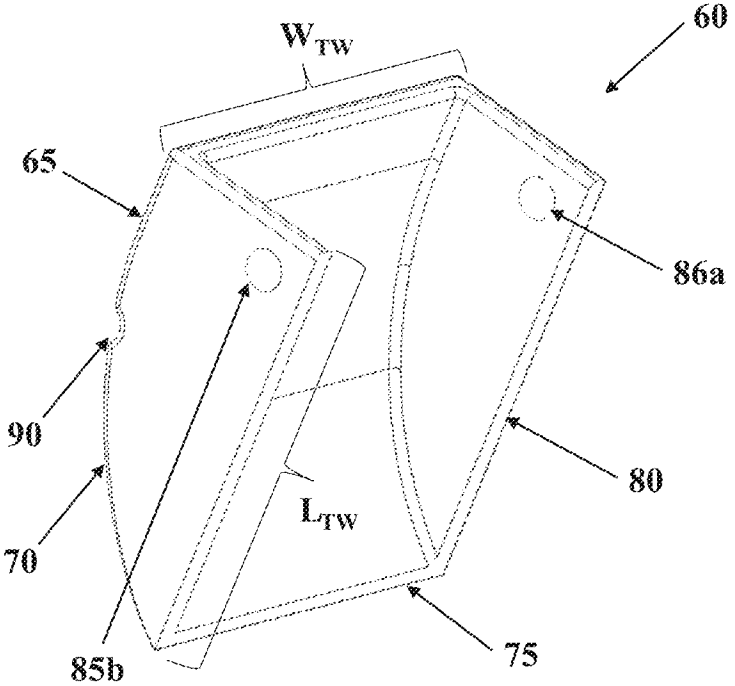
FIGS. 7*a*-7*d* illustrate an exemplary tape-wedge.
Figure 7A:
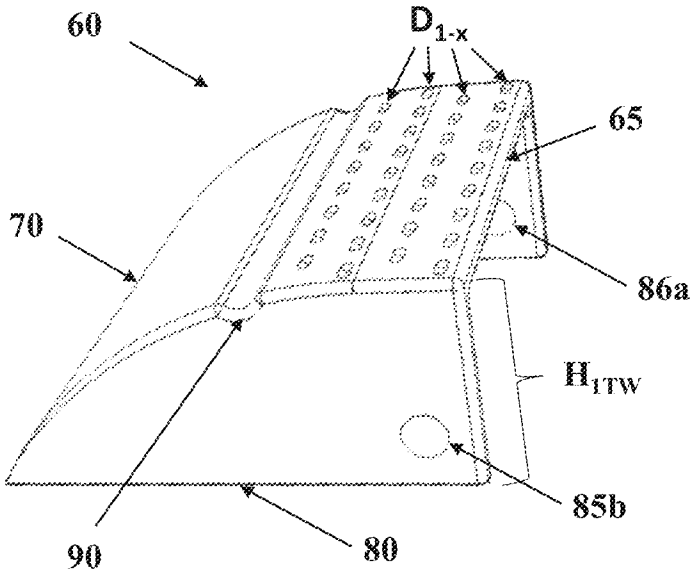
Figure 7D:
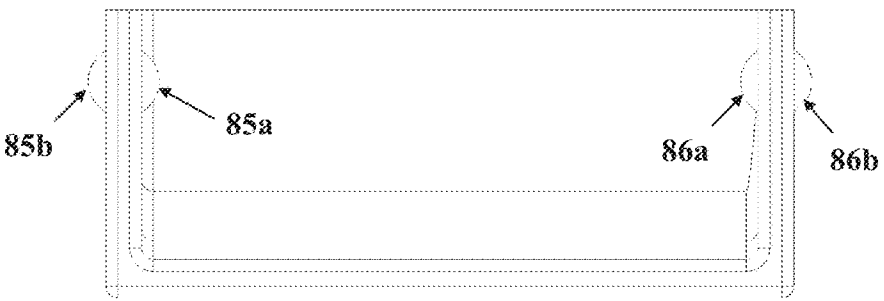
Figure 7C:
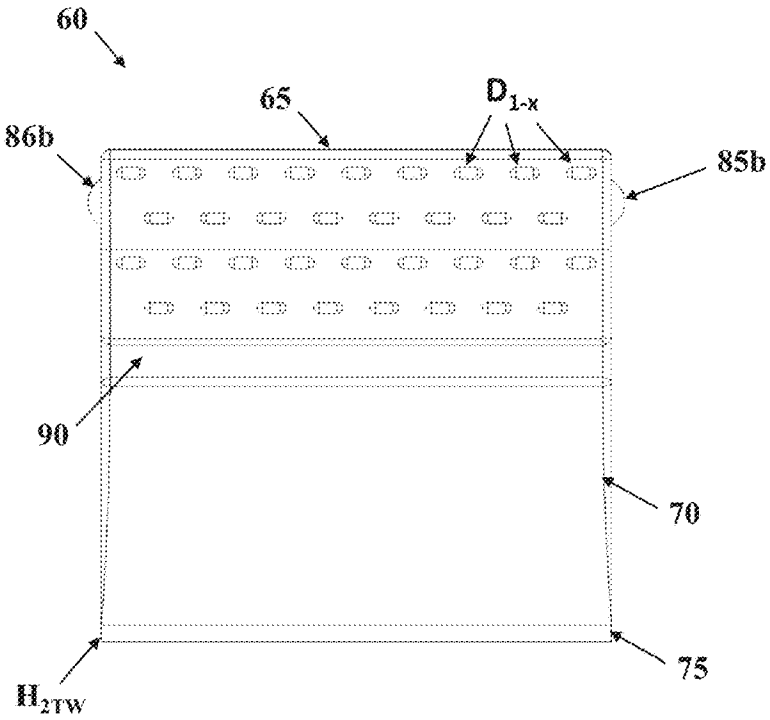

Referring to FIGS. 7*a*-7*d*, an embodiment of a tape-wedge 60 is shown. The tape-wedge 60 is a one-piece construction which is preferably formed of a plastic material. The primary components of the tape-wedge 60 include a textured grip portion 65, a tape rest portion 70, a blade edge 75, and straight base 80 molded into a single product. The tape-wedge 60 includes semicircular tape roll ball grippers each having inner 85*a*, 86*a*, and outer gripper portions 85*b*, 86*b*. As shown in FIGS. 7*a*, 7*b* and 7*d*, the inner gripper portions 85*a*, 86*a* are located on inside facing side walls of the tape-wedge and are used to grip the remaining unused portion of the tape roll. The outer gripper portions 85*b*, 86*b* are located opposite the inner gripper portions on the outside facing side walls of the tape-wedge and provide a mechanism for the user to grip the tape-wedge 60. Additionally, tape-wedge is formed with a trough 90 at the intersection of grip portion 65 and tape rest portion 70. The textured grip portion 65 may include a pattern of indentations or divots $D_{1-x}$ formed therein. The number and pattern of divots may be optimized to maximize user grip, while maintaining structural integrity.

Figure 8:
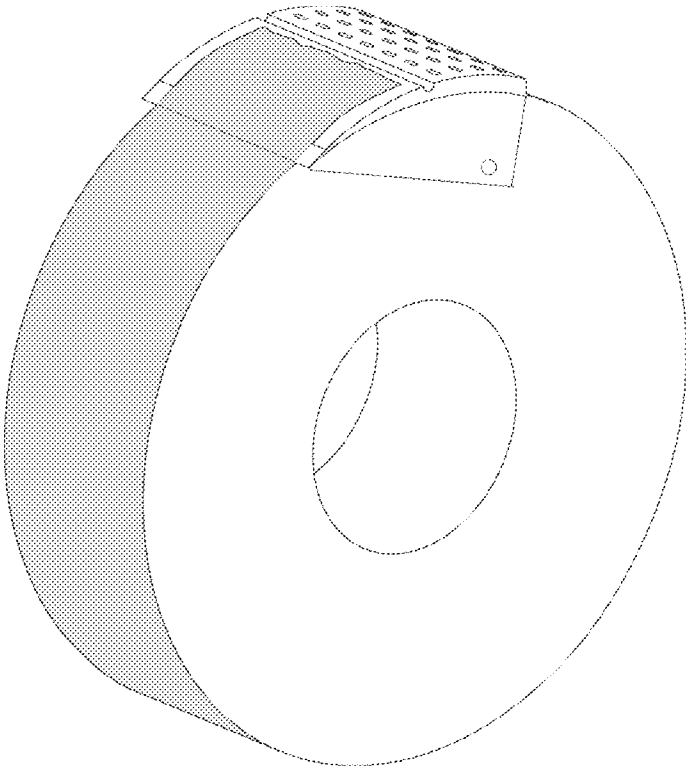
FIG. 8 illustrates the exemplary tape-wedge of FIGS. 7*a*-7*d* with the leading edge of the tape adhered to the tape rest section of the exemplary tape-wedge and the tape-wedge gripping the remaining adhesive roll.

FIG. 8 illustrates the tape-wedge when fully engaged with an exemplary tape roll. Although not limited as such, the tape-wedge is useful for larger width tape roll varieties, e.g., packing tape. The dimensions $L_{TW}$, $W_{TW}$, $H_{1TW}$, $H_{2TW}$ of the exemplary tape-wedge may vary in accordance with the dimensions of the tape roll with which they are intended to be used. In particular, the width of the tape roll dictates W (see Table 1). By way of example, tape-tabs 10*a* and 10*b* illustrated herein generally have the approximate dimensions: $L_{TW}$=22.4 mm; $W_{TW}$=24 mm; $H_{1TW}$=9.8 mm and $H_{2TW}$=tapered to point. Additionally, blade edge 75 is approximately 1.3 mm. While the value for width ($W_{TW}$) is generally driven by the width of the tape roll, the value for $H_{1TW}$ (also referred to as thickness) is generally less than 10.0 mm. The values provided herein are in no way intended to be limiting.

In addition to the uses described herein for providing quicker and easier access to tape from a tape roll and for improved storage of a tape roll, the tape-tab and tape-wedge may be used to scrape adhesive tape off of non-paper like surfaces once the tape has been adhered to the surface.

I claim:

1. A system for accessing and storing tape on a tape roll, the system comprising:

a tape roll;

a device consisting of the following portions in a single unitary construction:

a textured grip portion including a pattern of indentations therein, wherein the textured grip portion includes two side edges and a first end thereof for contacting a surface of the tape roll;

a tape rest portion tapered to a straight blade edge, wherein the straight blade edge and the first end of the textured grip portion form opposite ends of the device; and a curved base opposite an entirety of the textured grip portion, the tape rest portion, and the straight blade edge such that the curved base rests substantially on the surface of the tape roll wherein a width of the device is approximately equal to a width of a roll of tape, wherein the textured grip portion and the tape rest portion are separated by a semi-circular ridge formed approximately in the middle of the device and further wherein an end of the tape roll rests directly on the tape rest portion when the tape roll is not in use to prevent the end of the tape roll from re-adhering to the tape roll.

2. The system of claim 1, wherein a curve of the textured grip portion, a curve of the tape rest portion and a curve of the blade edge are approximately parallel.

3. The system of claim 1, wherein a thickness of the device is less than 2 mm.

4. The system of claim 1, wherein the pattern of indentations therein includes multiple divots.

5. A system for accessing and storing tape on a tape roll, the system comprising:

a tape roll;

a device consisting of the following portions in a single unitary construction:

a top curved surface including a textured grip portion including a pattern of indentations therein, wherein the textured grip portion includes two side edges and a first end thereof for contacting an outer surface of the tape roll;

a tape rest portion tapered to a straight blade edge, wherein the straight blade edge and the first end of the textured grip portion form opposite ends of the device;

wherein the textured grip portion and the tape rest portion are separated by a semi-circular ridge formed approximately in the middle of the device and further wherein an end of the tape roll rests directly on the tape rest portion when the tape roll is not in use to prevent the end of the tape roll from re-adhering to the tape roll; and a bottom curved surface opposite an entirety of the top curved surface such that the bottom curved surface rests substantially on the outer surface of the tape roll, wherein the top curved surface and the bottom curved surface are approximately parallel and further wherein the top curved surface and the bottom curved surface are separated by less than 2 mm at a first end of the device and less than 1 mm at a second end of the device.

6. The system of claim 5, wherein the pattern of indentations therein includes multiple divots.

7. A system for accessing and storing tape on a tape roll, the system comprising:

a tape roll;

a device consisting of the following portions in a single unitary construction:

a textured grip portion including a pattern of indentations therein, wherein the textured grip portion includes two side edges and a first end thereof for contacting an outer surface of the tape roll;

a tape rest portion separated from the textured grip portion by a semi-circular ridge, the tape rest portion including a first curved slope portion, a bevel portion and a straight blade edge, wherein the straight blade edge and the first end of the textured grip portion form opposite ends of the device; and a curved base opposite an entirety of the textured grip portion and the tape rest portion, wherein an edge of the tape roll is loosened by the straight blade edge and rests directly on the tape rest portion when the tape roll is not in use to prevent the loosened edge of the tape roll from re-adhering to the tape roll.

8. The system of claim 7, wherein the pattern of indentations therein includes multiple divots.

* * * * *